United States Patent [19]

Bergman et al.

[11] 4,395,036

[45] Jul. 26, 1983

[54] SHEET FEEDER WITH STACK-HOLDING TRAY HAVING FLEXIBLE-BAND-COUPLED GUIDE ELEMENTS

[75] Inventors: Carl A. Bergman, South Dartmouth; Roy L. Thomas, New Bedford; Richard A. Bourbeau, North Dartmouth, all of Mass.

[73] Assignee: Standard Duplicating Machines Corporation, New Bedford, Mass.

[21] Appl. No.: 327,779

[22] Filed: Dec. 7, 1981

Related U.S. Application Data

[60] Division of Ser. No. 204,559, Nov. 6, 1980, abandoned, which is a continuation of Ser. No. 33,740, Apr. 26, 1979, abandoned.

[51] Int. Cl.[3] ..... B65H 1/04

[52] U.S. Cl. ..... 271/171; 271/223

[58] Field of Search ..... 271/171, 167, 169, 170, 271/144, 238, 240, 223, 224

[56] References Cited

U.S. PATENT DOCUMENTS

| | | | |
|---|---|---|---|
| 390,277 | 10/1888 | Allen | 271/121 |
| 2,224,138 | 12/1940 | Trydal | 271/37 |
| 2,343,187 | 2/1944 | Jagger | 271/121 |
| 2,622,518 | 12/1952 | Peterson et al. | 271/10 X |
| 2,785,893 | 3/1957 | Ford et al. | 271/169 |
| 2,887,316 | 5/1959 | Tobey | 271/125 |
| 3,339,916 | 9/1967 | Tregay | 271/170 |
| 3,360,259 | 12/1967 | Stewart | 271/124 |
| 3,411,768 | 11/1968 | Gatti | 271/10 |
| 3,795,395 | 3/1974 | Ransom et al. | 271/125 X |
| 3,804,400 | 4/1974 | Hunt et al. | 271/10 |
| 3,838,851 | 10/1974 | Kolibas | 271/124 |
| 4,004,795 | 1/1977 | Agnew et al. | 271/118 X |
| 4,025,187 | 5/1977 | Taylor et al. | 271/10 X |
| 4,032,135 | 6/1977 | Ruenzi | 271/116 |
| 4,074,902 | 2/1978 | Bradbury | 271/125 X |
| 4,113,245 | 9/1978 | Colglazier et al. | 271/10 |

FOREIGN PATENT DOCUMENTS

| | | | |
|---|---|---|---|
| 1102768 | 3/1961 | Fed. Rep. of Germany | 271/171 |
| 800187 | 8/1958 | United Kingdom | 271/160 |
| 627039 | 10/1978 | U.S.S.R. | 271/127 |

*Primary Examiner*—Bruce H. Stoner, Jr.

[57] ABSTRACT

Apparatus for holding a stack of sheets for entry into a sheet feeder, wherein there is provided a tray for vertically supporting the stack, left and right guide elements moveable toward and away from the lateral edges of the stack for centering the stack in the tray, and a flexible band formed in a loop, the band being attached to the guide elements at two locations, such that the guide elements move inward and outward laterally in unison, and the band being supported beneath the tray, and wherein the band is bent (e.g., around a convex surface) during inward movement of the guide elements so that when the movement stops the band tends to move the guide elements outwardly as it assumes an equilibrium position, thereby preventing overtightening of the guide elements against the stack.

5 Claims, 5 Drawing Figures

FIG 1
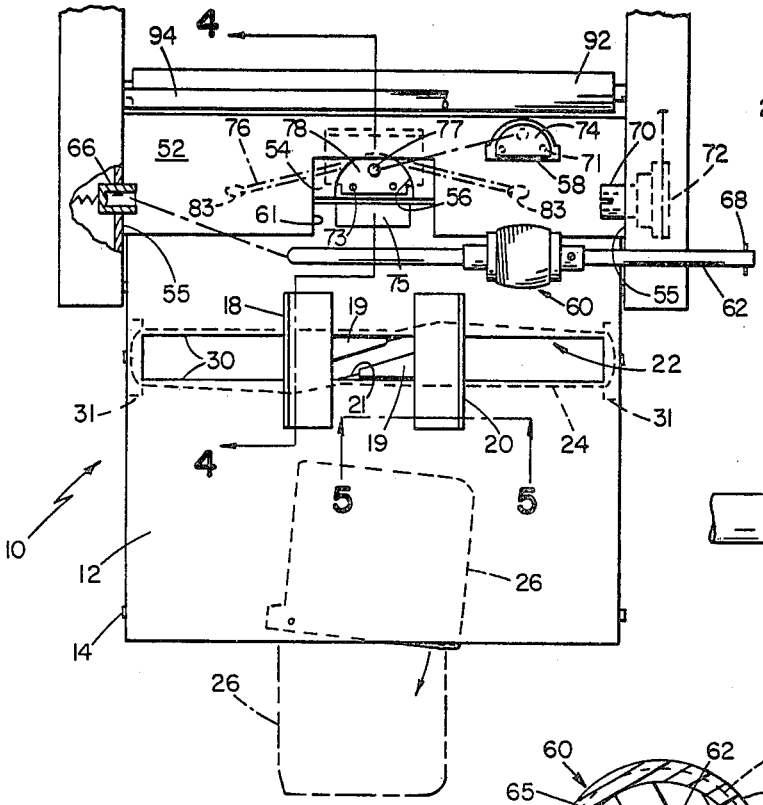
FIG 5
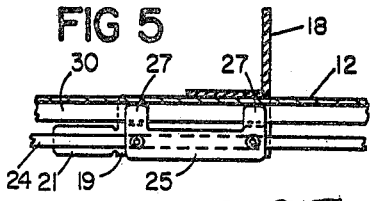
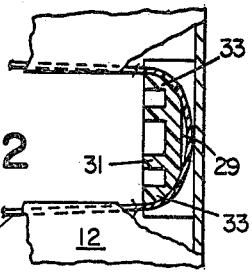
FIG 2
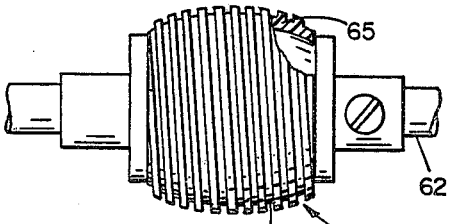
FIG 3
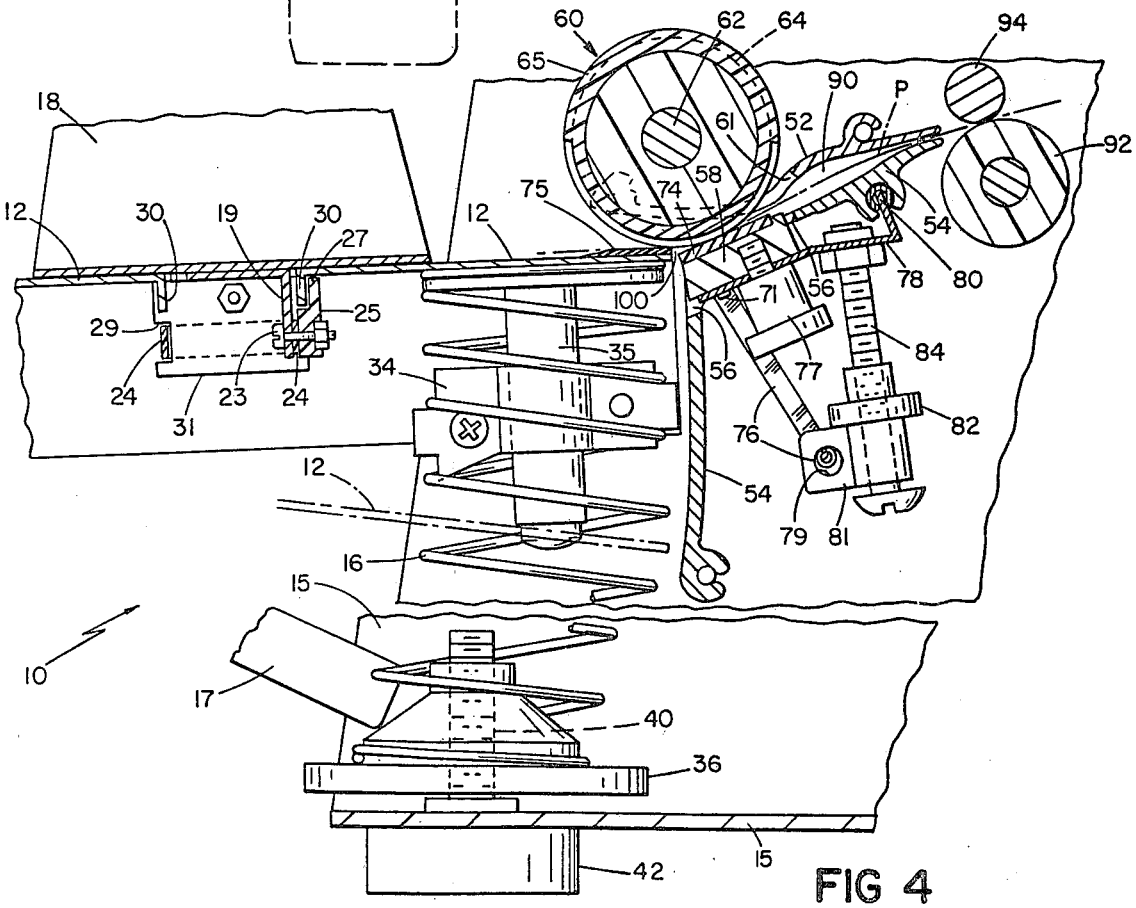
FIG 4

SHEET FEEDER WITH STACK-HOLDING TRAY HAVING FLEXIBLE-BAND-COUPLED GUIDE ELEMENTS

This application is a divisional of application Ser. No. 204,559, filed Nov. 6, 1980, now abandoned, which in turn is a continuation of application Ser. No. 33,740, filed Apr. 26, 1979, now abandoned.

FIELD OF THE INVENTION

This invention relates to mechanisms for feeding sheets.

BACKGROUND OF THE INVENTION

In duplicatiors and other devices, single sheets of paper (and similar materials) must be fed into the device from a stack of sheets. The top sheet must be broken free of the lower sheets in the stack and fed without wrinkling into rollers that do the printing. Particularly in fluid duplicators, there is a need to feed different types of paper without making adjustments to the feeder. Types of paper vary from stiff file cards to very thin paper, and include paper that has already been printed on and thereby made limp by moistening and which is being passed through for printing on the reverse side. Furthermore, the feeder should be capable of handling various height stacks of sheets without adjustments being necessary.

Taylor et al. U.S. Pat. No. 4,025,187 shows a sheet feeder with a sheet retarding pad pivoted from a slightly downstream axis against the middle of a feed belt. It also shows resilient elements for flattening the paper buckle as the paper is drawn in by registration rolls.

Ruenzi U.S. Pat. No. 4,032,135 shows a separating gate pivoted about an upstream axis against three feed rolls. The gate is coated with four rubber strips and is spring biased toward the rolls by a spring upstream of the pivot axis. Paper is held in a tray that pivots downward at its front end against a spring, and the tray axis is positioned forward of the rear of the paper stack.

SUMMARY OF THE INVENTION

It has been found that excellent sheet separation of many different weight and type papers (and other materials) can be had without the need for operator adjustments in a simple, rugged, and relatively low-cost feeder. The feeder accomodates the various papers without wrinkling any of them, without needing to slow down for some, and with good print registration (vertical location on page) for all. Furthermore, it will accomodate a thick stack (e.g., 500 sheets) of paper without feed adjustments, and provides a simplified and more reliable stack centering mechanism.

In one aspect, the invention features a feed roll positioned above a pivoting separator pad, the pad and roll defining a zone into which several sheets of paper enter and in which the friction imparted by the pad works to retard all but the top sheet and the pad pivoting about an axis spaced downstream of the region of contact between the pad and the roll and the axis being positioned such that the moment arm for frictional forces imparted on the pad is less than the downstream distance. The pivoting action of the pad in combination with the feed roll increases the frictional force only during separation, thereby providing the needed separation friction for many types of paper (and like materials)

without providing so much friction as to wrinkle lightweight papers. In preferred embodiments, the pad is inclined upward and spring biased (e.g., 0.2 lb) upward against the feed roll and means are provided to bias (e.g., 0.6 lb) the top sheet against the feed roll; a urethane shoe on the pad provides friction with paper (e.g., coefficient of 1.0) and resists abrasion; the feed roll has a neoprene outer layer ground with grooves to increase compliance and enhance paper friction (e.g., coefficient of 1.6); the separator pad and feed roll extend through openings in lower and upper guide surfaces; a pivoting paper tray supports the stack of paper, with a coil compression spring under the tray compensating for the weight of paper added to the tray to keep approximately constant the upward bias of the top sheet against the feed roll; a cylindrical stop surface at the front of the paper tray stops all but the top several sheets from entering the feeder; the tray pivot axis is located such that long (e.g., longer than 11 inches) paper extends beyond the axis onto an extendable element and tends thereby to force the front end of the tray upward with greater force; and an element is provided for adjusting the number of active coils in the spring to adjust the gradient during assembly.

In another aspect, the invention features centering the stack of paper on a tray using two guide elements connected together beneath the surface of the tray by means of a flexible band formed in a loop, the guide elements being fastened to the loop at two locations spaced about halfway around the loop from each other such that the guides move inward in unison. In preferred embodiments, the band is supported in a groove in each of two guide blocks at each lateral side of the tray; the tray has a slot running transversely across it with integral bent-down tabs along each longitudinal edge of the slot, and the tabs cooperate with extensions of the guide elements and clamping members to provide a track for the guide elements; and deformation of the band around corners of the guide blocks gives a slight outward movement of the guide elements away from the stack to reduce binding thereof.

In another aspect, the invention features assuring uniform print registration (no variation of print vertically on the paper) for varying type papers requiring different feeding times by providing a longer delay period between activating a feeding means (e.g., a feed roll and separator pad) and activating a registration means (e.g., a registration roll and idler roll), providing a buckling restraint region formed by a separation between upper and lower paper guide surfaces between the feeding and registration means to limit the amount of buckling that occurs before activation of the registration means, and adapting a feed surface of the feeding means to slip with respect to the paper as a consequence of the paper being constrained from further buckling by the buckling-restraint region. In preferred embodiments, the lower guide surface is inclined uphill and curved to cause paper to predictably buckle upward toward the upper guide surface, and the guide surfaces are aluminum extrusions extending the full transverse width of the paper.

In still another aspect of the invention, the feed roll of the feeder is narrow and barrel-shaped (e.g., 1.5 inch central diameter reduced to about 1.44 inch edge diameter) to minimize the contact surface with paper to allow rotation of the paper during feeding for alignment.

PREFERRED EMBODIMENT

The structure and operation of a preferred embodiment of the invention will now be described, after first briefly describing the drawings.

DRAWINGS

FIG. 1 is a plan view of said embodiment, showing a feed roll and separator pad exploded from their normal positions.

FIG. 2 is a cross-sectional view of a guide block located under a paper tray of said embodiment.

FIG. 3 is an enlarged view, partially cross-sectioned, of the feed roll.

FIG. 4 is a cross-sectional view at 4—4 of FIG. 1, showing the feed mechanism and a portion of the paper tray (in its empty position).

FIG. 5 is a cross-sectional view at 5—5 of FIG. 1.

STRUCTURE

Turning to the figures, there is shown a sheet feeder indicated generally at 10, for a duplicating machine.

Paper is stacked in tray 12 (shown empty), which pivots about axis 14 (FIG. 1) against coil spring 16. Support for axis 14 is provided by cantilever arms 17 (FIG. 4) extending from left and right sides of frame 15. Paper is centered left to right in the tray by guides 18, 20 sliding in transverse slot 22 and clamped underneath the tray surface to Mylar band 24 (15 mils thick) (FIGS. 4 and 5). Each guide is clamped to band 24 via lower, welded extension 19, screws 23, and clamp member 25. Each member 25 has two fingers 27 that cooperate with each extension 19 and bent-down tab 30 (integral with tray 12) to provide a track for the guides. The band slides through grooves 29 in blocks 31 (FIG. 2) at each end of slot 22. In horizontal cross section (FIG. 2), grooves 29 have rounded corners 33. Tabs 21 extending from lower extensions 19 of the guides deflect the band outward (FIG. 1) to take up slack in the band. Support panel 26 swings out from under tray 12 to the position shown in dashed lines in FIG. 1 to support long paper (more than about 11 inches long).

Coil spring 16 biases tray 12 upward against a feed roll 60 (0.6 lb bias with no paper). The bias and gradient (lb/in) of the spring can be adjusted. Element 34 clamped to post 35 is positioned along the coils of the spring during assembly to vary the number of active coils (from ten to seven) and thereby adjust the gradient. A gradient of about 2.5 lb/in is preferred. The bias of the spring can be adjusted by raising bottom plate 36, threaded onto post 40. The post also serves to fasten foot pad 42 to frame 15 of the duplicator.

Sheets of paper enter the feed path of the duplicator through a mouth formed between upper and lower guide plates (aluminum extrusions) 52, 54 and left and right frame surfaces 55. Lower guide plate 54 extends downward and forms a curved stop plate for paper held in tray 12, the curvature being cylindrical with an axis of revolution spaced slightly above and upstream of axis 14. This axis location causes the front edge of the stack of sheets to move away from the stop surface as the sheets are depleted and tray rises, thereby avoiding binding of the paper against the stop surface.

Feeding of paper is initiated by rotation of feed roll 60 on shaft 62. The roll is positioned in U-shaped cutout 61 in upper guide plate 52. A Neoprene compound treated with an antiozidant to prevent glaze over of the outer surface is used as the outer layer 65 of roll 60. The compound has a Shore durometer of 25–30 and a coefficient of friction to paper of 1.6. To assure good friction with paper, the outer surface of the roll is ground to remove any outer coating, and helical groove 64 (1/16 inch deep; 1/16 inch wide) is cut in the Neoprene to increase its compliance. The groove enhances friction without necessitating the use of softer and stickier rubber materials, which pick up paper lint. As can be seen in FIG. 3, roll 60 has a barrel shape (exaggerated in the figure) with a 30 mil radial crown. The diameter tapers down from a maximum of 1.50 inches at the center to 1.44 inches at the edges. The concentricity of the surface of roll 60 to the axis of shaft 62 is held to a close tolerance (less than 10 mils total indicator readout of variation). Shaft 62 and roll 60 are easily removed by leftwardly translating the shaft against spring biased trunnion 66 far enough to remove ears 68 from coupler 70 in driven member 72.

Separator pad 58, exposed through aperture 56 in lower guide plate 54, cooperates with feed roll 60 in feeding new sheets. Pad 58 has an upper frictional shoe 74 of urethane (1/16 inch thick, Shore durometer of 72, and coefficient of friction to paper of 1.0). The urethane resists abrasion without changing its frictional coefficient (with paper).

A similar urethane in the form of a pressure sensitive tape (3M #8560, Shure durometer of 85, 0.013 inches thick, and lower coefficient of friction than pad 58) is applied to the top of protuberance 75 on the end of tray 12. The tape provides friction for separation of the last few sheets of the stack to prevent multiple feed of the last sheets.

Thumb screw 77 attaches pad 58 to pivoting member 78, which is, in turn, hinged from lower extrusion 54 at axis 80, downwstream of and below the pad location. The pad is aligned with member 78 by pins 71 in the pad being received by holes 73 in member 78. Coil spring 76 cooperating with pivoting member 78 biases the pad against feed roll 60 (normal bias of 0.2 lb). The spring is slung through hole 79 in lower element 81 from left and right attachment points 83 (FIG. 1) under lower guide plates 54. This spring arrangement gives a low spring gradient so that the bias force does not vary significantly for vertical movement of the pad, such as for thicker than ordinary sheets. Thumb wheel 82 turning on screw 84 moves element 81 in relation to member 78, and thus adjusts the stretch of spring 76 and thus the amount of pad bias against the feed roll. Lateral movement of points 83 can also be done to change the spring bias.

After passing between feed roll 60 and separator pad 58, an entering sheet follows paper path P through buckle-restraint region 90, formed by an increase in the separation between upper and lower guide plates 52, 54, and past registration roll 92, working against idler roll 94. From there the paper passes through further downstream stages (not shown) of the duplicator.

OPERATION

Paper is loaded into tray 12 with the forward paper edges resting against the curved stop plate formed by the lower end of guide plate 54. Tray 12 is shown empty in FIG. 4. When full it is rotated downard to the position shown in broken lines. Thus paper enters at a downward angle when the tray is full and at a slight upward angle when the tray is nearly empty.

To center the paper, guides 16, 18 are slid inward against the lateral edges of the paper. Band 24 connecting the two guides assures that they move inward in unison. When released after reaching the edges of the paper, the guides tend to move slightly away from the paper, thereby assuring that no restraint is put on the paper. The slight outward movement results, at least in part, from relaxation of the Mylar band to an equilibrium position after being deformed (i.e., bent) around corners 33 of guide blocks 31. Corners 33 provide a convex surface about which the band is bent during inward movement of the guides.

Paper is drawn into the duplicator by feed roll 60 cooperating with separator pad 58. When roll 60 is rotated, several sheets of paper are drawn into zone 100. Only the top sheet is contacted by the feed roll, but paper-to-paper friction causes the additional sheets to initially move forward. To stop further forward movement of all but the top sheet, separator pad 58 applies a retarding frictional force to the lower sheets. The urethane-to-paper friction is greater than the paper-to-paper friction, and thus the lower sheets are held back. The pad friction also works on the top sheet, but the rubber-to-paper friction provided by roll 60 overcomes the pad friction.

The upward inclination of pad 58 causes the several sheets entering zone 100 to initially contact the pad somewhat edge on, thereby enhancing the friction applied by the pad. The inclination also causes a staggered advance (shingle like) of the sheets in the zone, thus assuring that the pad contacts each sheet.

During paper feeding the upward force of pad 58 is increased. This is accomplished by pivoting the pad on member 78 about pivot axis 80, which is positioned slightly below paper path P. When frictional forces are applied by the pad, the resultant forward forces on the pad creates a torque via the moment arm between axis 80 and the force direction to force the pad upward, thereby further increasing the frictional force. Pad upward force is greatest at the moment when the several sheets of paper are forced against the pad and before the top sheet has been broken away by the feed roll. At that moment, the static friction of the top and lower sheets against the pad places the greatest forward force on the pad and thus the greatest turning moment and upward force. Once the top sheet breaks free of the others, the force on the pad drops to the dynamic friction imparted by the top sheet as it moves past the pad and lower sheets. This arrangement of increasing the pad force at the moment of separation, allows a greater range of papers (stiff cards through limp paper) to be successfully fed one sheet at a time without adjustments.

After the top sheet breaks free of the lower sheets, it travels inward and uphill through region 90 until reaching registration roll 92, which is not yet rotating. The registration roll begins rotating after a fixed delay period that is sufficient to jam the leading edge of the sheet between the registration roll and idler roll 94. This assures proper registration of the paper with the printing elements of the duplicator. If this were not done, differences in the time reguired to feed sheets of paper would cause vertical variation in the print location on the paper.

During the short inward movement of the top sheet, the edges of the sheet are in contact with lateral guide surfaces of guides 18, 20 (FIG. 1) and the center is in contact only with the center of barrel-shaped feed roll 60. The small contact area of roll 60 allows the sheet to rotate slightly about a generally vertical axis to correct any initial angular misalignment.

After the front edge of the sheet reaches the stationary registration roll, the sheet buckles upward against upper guide plate 52. The guide plates prevent further buckling of the sheet, and feed roll 60 is forced to thereby slip relative to the sheet for a short period before registration roll 92 is activated. When roll 92 rotates, the sheet is drawn into the duplicator. Feed roll 60 is disengaged at the time rgistration roll 92 is engaged, and it free wheels under the force applied by the traveling sheet.

The uphill slope of the paper path between feed roll 60 and registration roll 92 makes the paper initially tend to follow lower plate 54 and to predictably buckle upward toward plate 52. The uphill slope is greatest midway between the feed and registration rolls and less at the registration roll. This further assures that paper buckles always upward toward plate 52 and assumes the shape of plate 52. (Stiff cards and the like may, of course, not buckle.)

The delay period between activating feed roll 60 and activating roll 92 is long enough to assure that the leading edge of the paper is jammed between idler roll 94 and registration roll 92 before the latter is activated. Because the time required to feed paper varies with the type paper and with the position of tray 12 (tilted down when full or up when empty), this delay period is made longer than is required in many instances. But this excess delay can be accomodated because of the buckling-restraint region 90 formed by the separation between upper and lower guide plates 52, 54. After paper reaches registration roll 94 it buckles upward a controlled amount until reaching upper guide plate 52, and then stops moving forward. This causes feed roll 60 to slip with respect to the stationary top sheet. The amount of time during which roll 60 slips is greatest when paper is most quickly fed into engagement with the registration roll.

As paper is fed from tray 12, the tray moves upward toward the feed roll under the force from spring 16, with the net upward bias on feed roll 60 held at about 0.6 lb for any tray position. This uniformity in upward bias is achieved by adjusting the gradient of spring 16 during assembly (using element 34) to compensate for the weight of ordinary $8\frac{1}{2}\times 11$ inch paper added to the tray. With papers that have different weights than $8\frac{1}{2}\times 11$ paper for the same stack height, the upward bias can vary (e.g., between about 0.3 and 1.2 lb), but this variation does not cause feeding difficulties with most papers.

Long paper is supported by rotating support panel 26 out from under the tray. Because a portion of the long paper extends past the pivot axis 14 of the tray, the upward bias of the tray on feed roll 60 is conveniently increased for longer paper. The greater bias compensates for the greater force required to cause the longer paper to break free of the stack.

As pointed out above, the angle at which paper is fed into the feed mechanism changes between the full and empty positions. E.g., in the full position, paper must bend around the feed roll at the separator pad. These differences are accomodated, however, by the action of pad 58 in gripping the lower sheets during separation and by the relatively long delay period before activation of the registration roll.

Other embodiments of the invention will occur to those skilled in the art and are within the following claims.

What is claimed is:

1. Apparatus for holding a stack of sheets for entry into a sheet feeder, comprising:

a tray for vetically supporting said stack, left and right stack guide elements moveable toward and away from the lateral edges of said stack for centering said stack in said tray, extensions of said stack guide elements that extend below said tray, a flexible band formed in a loop, said band being attached at a first location to a first of said extensions and a second location to the second of said extensions, said second location being about halfway around said loop from said first location, such that said stack guide elements move inward and outward laterally in unison, band guide elements at the lateral edges of and below said tray, said band guide elements having slot means for vertically restraining said band, and band-bending means for bending said band during inward movement of said stack guide elements so that when said movement stops the band tends to move said stack guide elements outwardly as it assumes an equilibrium position, thereby preventing overtightening of said stack guide elements against said stack.

2. The apparatus of claim 1 wherein said tray has an elongated transverse slot and bent-down integral tabs at either longitudinal edge of said slot, and said apparatus further comprises clamping members, said members being clamped to said extensions and band at said first and second locations and portions of said members being spaced from said extensions to provide a space for receiving said bent-down tabs, whereby said tabs, extensions, and clamping members cooperate to form a track along which said stack guide elements move.

3. The tray of claim 1 wherein said band is Mylar about 10 to 20 mils thick.

4. The apparatus of claim 1 wherein said band-bending means includes at least one convex surface, said surface being positioned and adapted to cause said band to bend thereon during said inward movement and having a radius of curvature less than that assumed by said band in said equilibrium position.

5. The apparatus of claim 4 wherein said band guide elements comprise blocks having slots for receiving said band and in horizontal cross section said slots have rounded corners with sharper curvature than assumed by said band in its equilibrium position after moving said guide elements, each of said rounded corners forming one said convex surface of said band-bending means.

* * * * *